US007883364B2

(12) United States Patent
Wu

(10) Patent No.: US 7,883,364 B2
(45) Date of Patent: Feb. 8, 2011

(54) CABLE ASSEMBLY HAVING SHROUD SUBSTANTIALLY COVERING MATED RECEPTACLE CONNECTOR

(75) Inventor: Chun-Kwan Wu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/632,849

(22) Filed: Dec. 8, 2009

(65) Prior Publication Data

US 2010/0144199 A1 Jun. 10, 2010

(51) Int. Cl.
*H01R 9/05* (2006.01)

(52) U.S. Cl. ..... 439/578

(58) Field of Classification Search ..... 439/578, 439/607.41, 108, 98, 579

See application file for complete search history.

(56) References Cited

U.S. PATENT DOCUMENTS

| | | | | |
|---|---|---|---|---|
| 5,387,124 | A * | 2/1995 | Shinohara et al. | 439/497 |
| 6,500,013 | B1 * | 12/2002 | Wang | 439/108 |
| 6,641,435 | B1 | 11/2003 | Ko | |
| 7,632,148 | B1 * | 12/2009 | Kawamura et al. | 439/607.41 |

* cited by examiner

*Primary Examiner*—Jean F Duverne
(74) *Attorney, Agent, or Firm*—Wei Te Chung; Andrew C. Cheng; Ming Chieh Chang

(57) ABSTRACT

A cable assembly (100) adapted for mating with a mating connector, includes an electrical connector (100) and a cable (120) electrically terminated to one end of the electrical connector. The electrical connector has an insulative housing (10), a number of contacts (20) received in the insulative housing, and a shielding shell (30) enclosing the insulative housing. The cable has metallic braiding layer (123). The cable assembly has a grounding plate (40) mechanically and electrically connecting with the braiding layer of the cable and the shielding shell.

12 Claims, 9 Drawing Sheets

CABLE ASSEMBLY HAVING SHROUD SUBSTANTIALLY COVERING MATED RECEPTACLE CONNECTOR

BACKGROUND OF THE INVENTION

1. Field of the Invention

The present invention relates to a cable assembly, and more particularly to a cable assembly having a connector with additional grounding bar interconnecting metallic braiding of a pair of coaxial cable terminated therein. This application relates to the copending applications of Ser. No. 12/569,902 filed Sep. 30, 2009 and Ser. No. 12/609,045 filed Oct. 30, 2009.

2. Description of Related Arts

U.S. Pat. No. 6,641,435, issued to Ko on Nov. 4, 2003 and entitled with "Vertically mated micro coaxial cable connector assembly", discloses a related art. According to the disclosure, a micro coaxial cable connector assembly (1) is disclosed and which includes a connector (10), a plurality of wires (20, 22), an upper grounding shield (30) and a lower grounding shield (40). The connector includes a mating portion (101), a plurality of terminals (102) received in the mating portion and a base (103) perpendicular to the mating portion. The base defines a plurality of canals (110). The terminals and the conductors are soldered together in the canals. The upper grounding shield is assembled to the mating portion in a first direction. The lower grounding shield is assembled to the base in a second direction perpendicular to the first direction. The wires have grounding braiding (201) surrounding conductors (202) thereof. The grounding braiding is electrically connected to the upper and lower grounding shields through upper and lower grounding bars (60, 62) received in the base of the conductor. Therefore, an electrically coupling between the shielding shell and the braiding layer of the cables is established.

Contacting surfaces between the spring arms and the corresponding braiding layers are small, (typically shown in FIG. 6, see elements 406/201). Therefore, the mechanical coupling between the cable connector and the cables and the electrical coupling between the shielding shell and the braiding layer are unreliable or vulnerable to shock and other severe working environment. Additionally, the shielding shell has a number of through holes defined around the spring arms. Therefore, dust can enter into the cable connector through the through holes. It is easy to break the electrical coupling between the spring arms and the braiding layers.

Hence, an improved cable assembly is required to overcome the above-mentioned disadvantages of the related art.

SUMMARY OF THE INVENTION

An object of the present invention is to provide a cable assembly featuring a robust interconnection between a shell and a metallic braiding so as to provide a reliable and robust coupling.

To achieve the above-mentioned object, a cable assembly adapted for mating with a mating connector, comprises an electrical connector and a cable electrically connected to one end of the electrical connector. The electrical connector has an insulative housing, a plurality of contacts received in the insulative housing, and a shielding shell enclosing the insulative housing. The cable has metallic braiding layer. The cable assembly has a grounding plate mechanically and electrically connecting with the braiding layer of the cable and the shielding shell.

According to one aspect of the present invention, The cable assembly has a grounding plate mechanically and electrically connecting with the braiding layer of cable and shielding shell. Thereby, a reliable mechanical connection between the electrical connector and the cable and an electrical connection between the braiding layer of the cable and the shielding shell are established. Additionally, it is no need to define any through hole to prevent dust from entering into the electrical connector.

DETAILED DESCRIPTION OF THE PREFERRED EMBODIMENT

Reference will now be made in detail to a preferred embodiment of the present invention.

Figure 1:
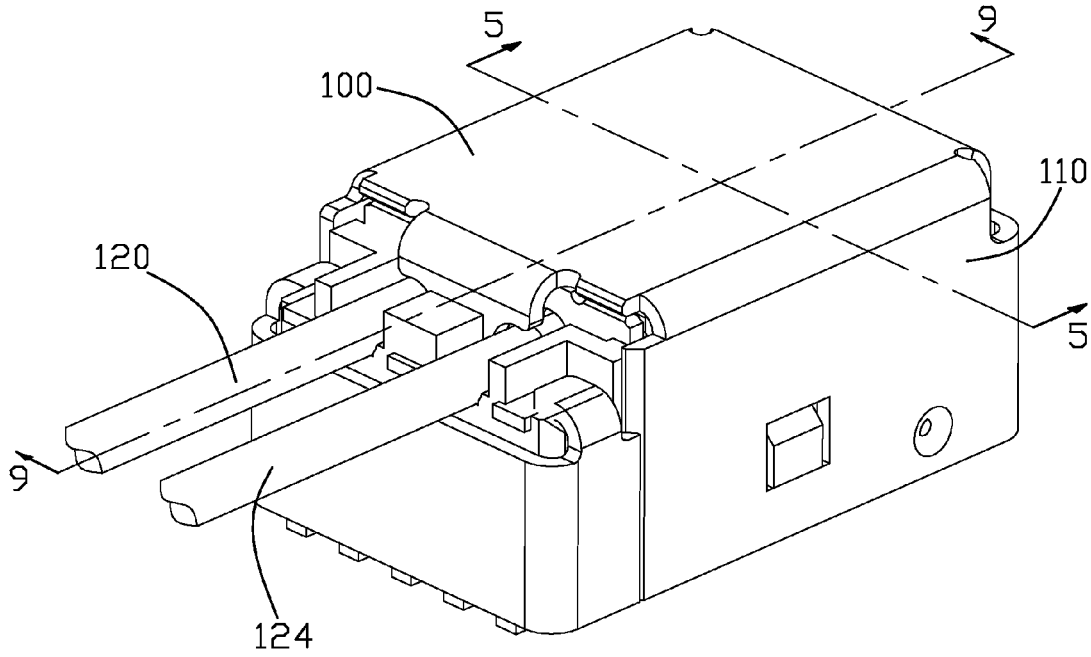
FIG. 1 is an assembled perspective view of a cable assembly in accordance with the present invention mated with a mating connector.
Figure 2:
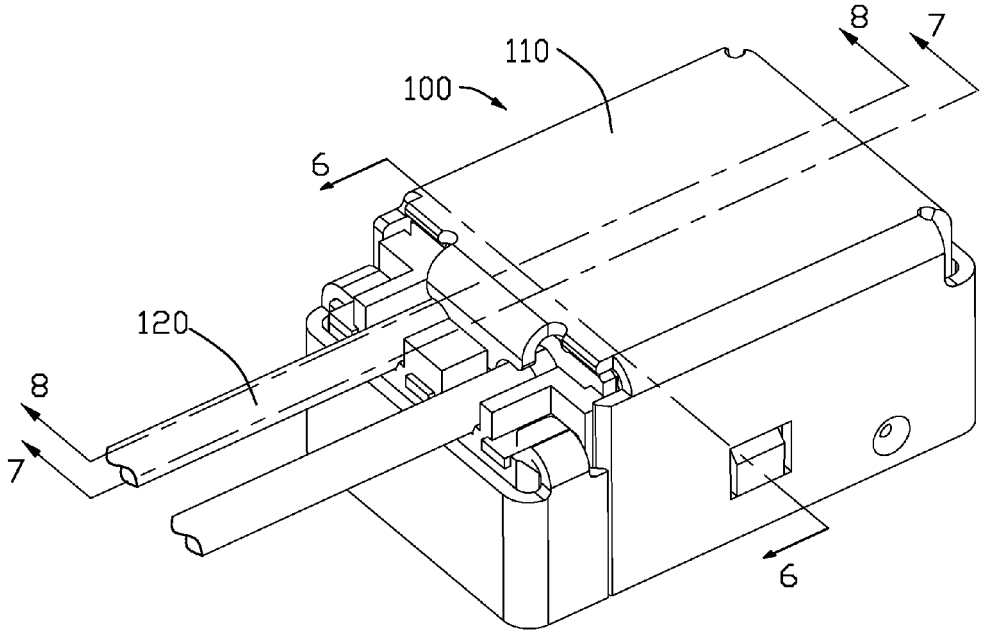
FIG. 2 is a perspective view of the cable assembly prior to connect with the mating connector as shown in FIG. 1.
Figure 2:
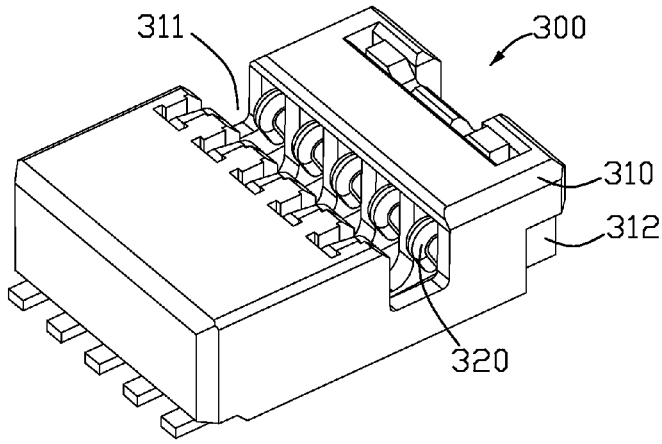

Referring to FIGS. 1 and 2, a cable assembly 100 made in accordance with a preferred embodiment of the present invention adapted for mating with a mating connector or receptacle connector 300 comprises an electrical connector or plug connector 110 and two coaxial cables 120 terminated to the electrical connector 110.

Figure 3:
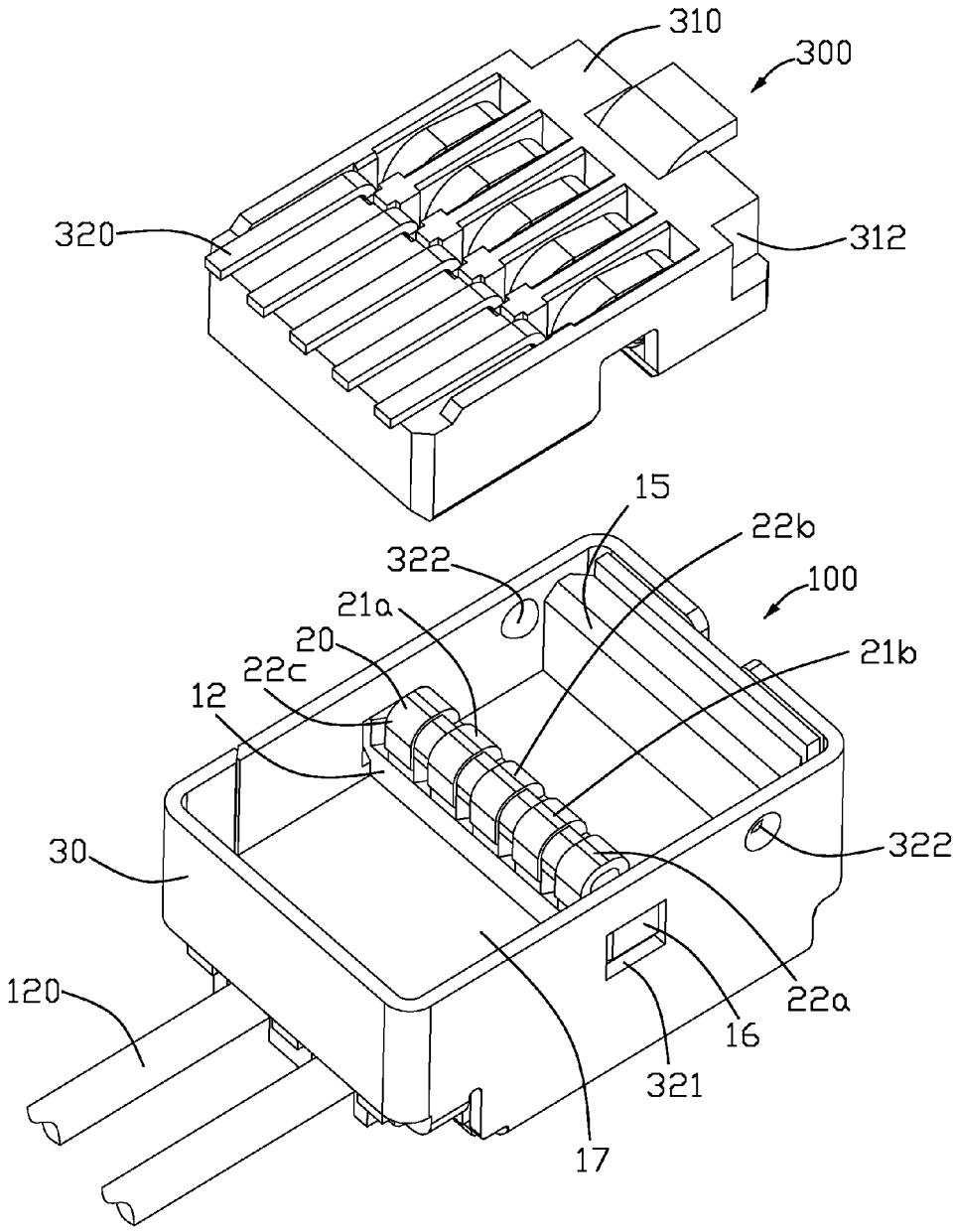
FIG. 3 is another perspective view of the cable assembly prior to connect with the mating connector as shown in FIG. 1.
Figure 4:
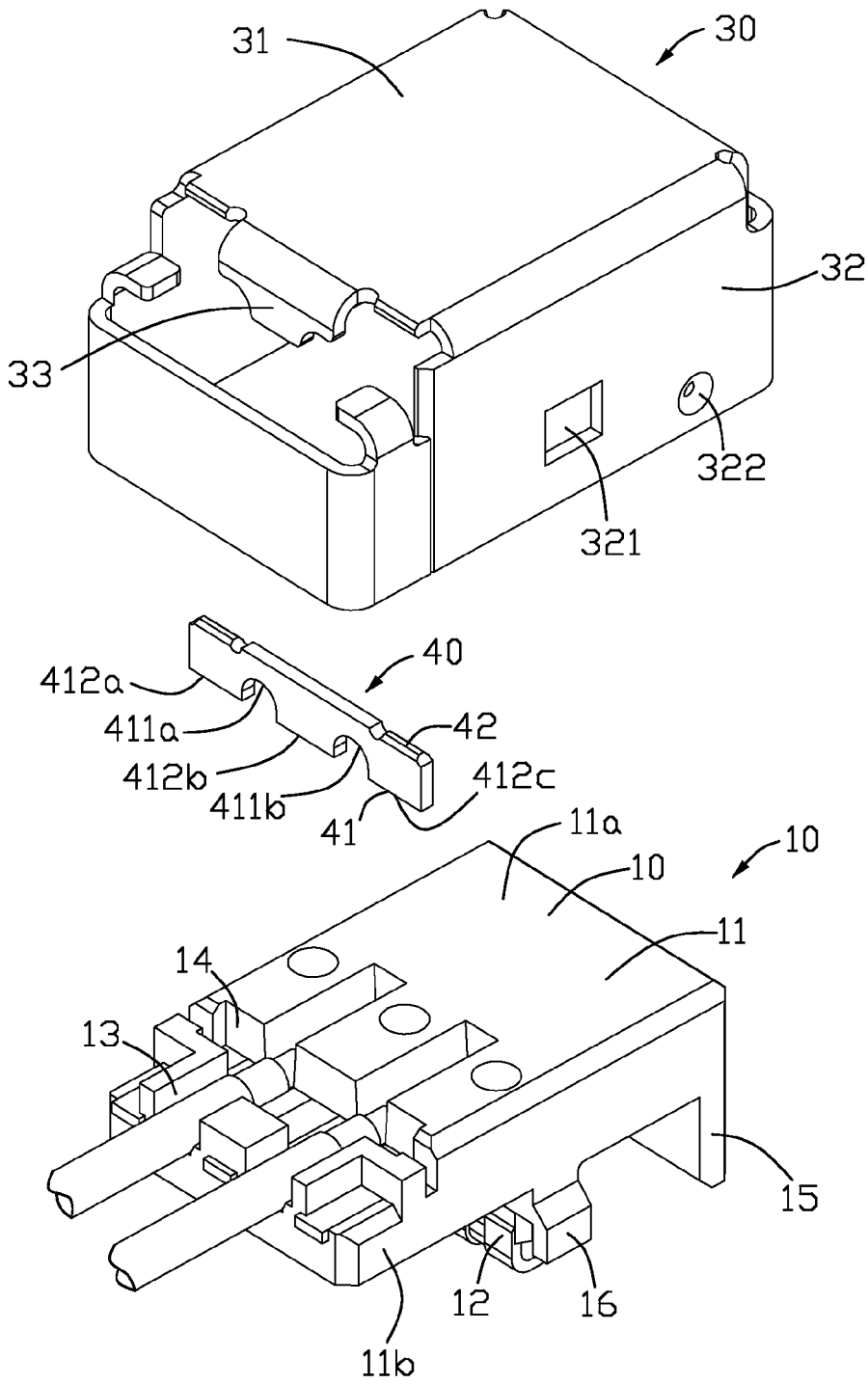
FIG. 4 is an exploded view of the cable assembly as shown in FIG. 1.
Figure 5:
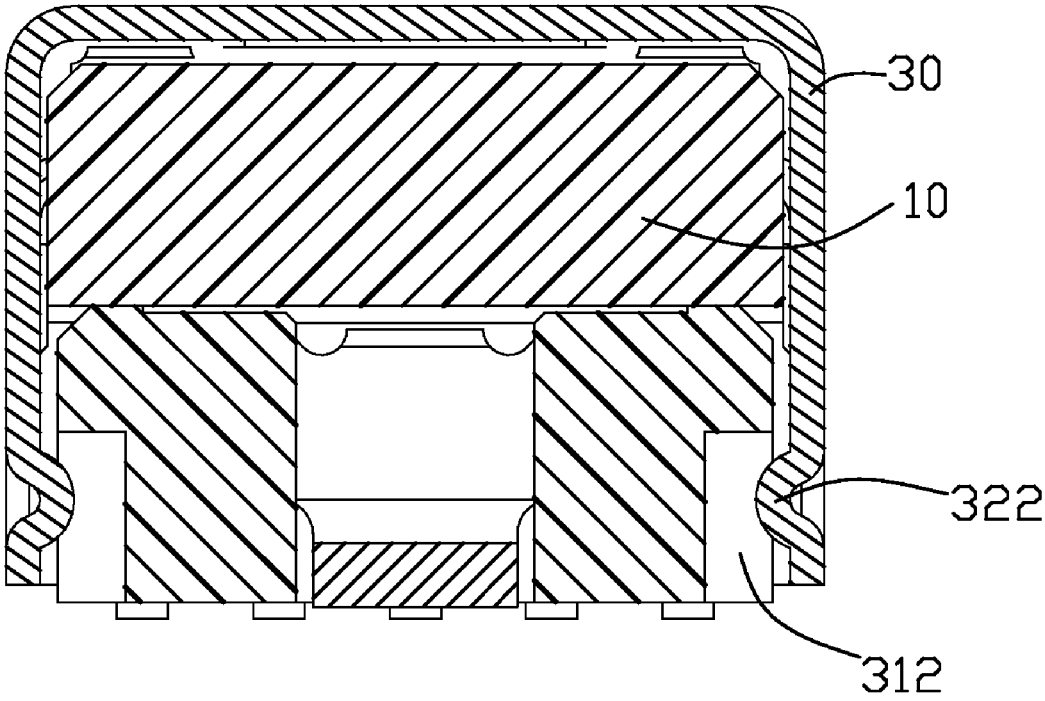
FIG. 5 is a cross-sectional view of the cable assembly mated with mating connector taken along line 5-5 of FIG. 1.
Figure 6:
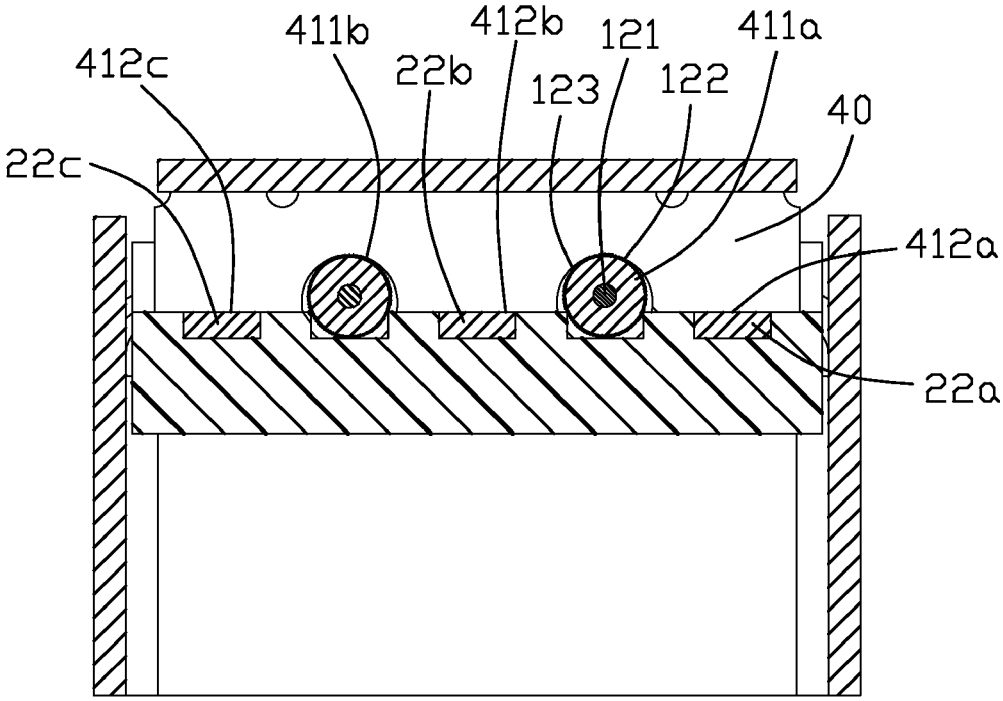
FIG. 6 is a cross-sectional view of the cable assembly taken along line 6-6 of FIG. 2.
Figure 7:
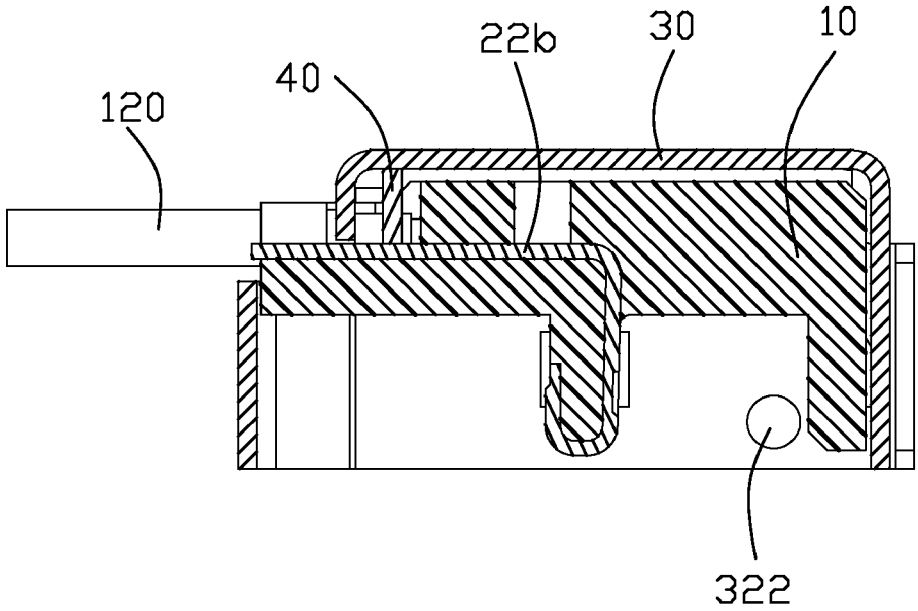
FIG. 7 is a cross-sectional view of the cable assembly taken along line 7-7 of FIG. 2.
Figure 8:
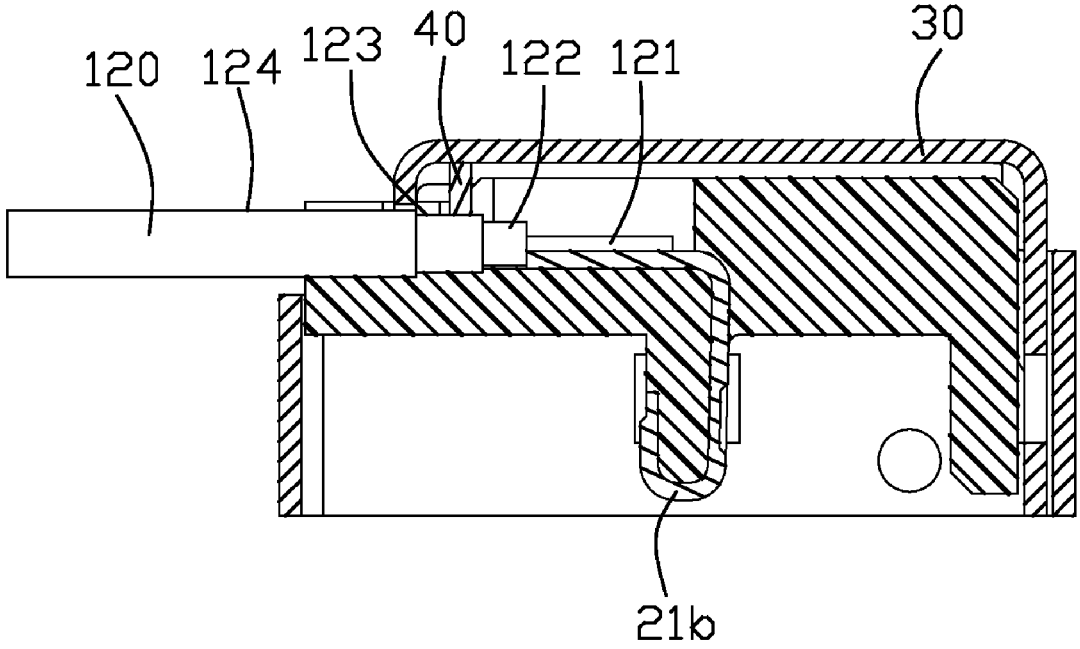
FIG. 8 is a cross-sectional view of the cable assembly taken along line 8-8 of FIG. 2.

Referring to FIGS. 3 and 4, the electrical connector 110 has an insulative housing 10, a contact set 20 received in the insulative housing 10, a shielding or metallic shell 30 enclosing the insulative housing 10, and a grounding plate 40 received in the electrical connector 110. Each of the cables 120 comprises a central conductor 121, an insulative layer 122 enclosing the central conductor 121, a braiding layer 123 enclosing the insulative layer 122, and a jacket 124 enclosing the braiding layer 123. The mating connector 300 comprises a mating housing 310 and a plurality of mating contacts 320 received in the mating housing 310. The mating contacts 320 are arranged to interconnect the contact set 20.

The insulative housing 10 comprises a planar base 11 having a first end 11*a* and an opposite second end 11*b*, a mating portion 12 substantially and vertically extending from a middle portion between the opposite ends 11*a*, 11*b*, a guiding portion 15 substantially and vertically extending from the first end 11*a* for guiding the electrical connector 110 to mate with the mating connector 300 in a right angle position, and two recesses 13 defined in the second end 11*b*. A retaining slot 14 extends along a first direction perpendicular to an extending direction of the cables 120. The mating portion 12 is formed with a pair of tubers 16. The mating portion 12 and the guiding portion 15 are located at the same side of the base 11.

Figure 9:
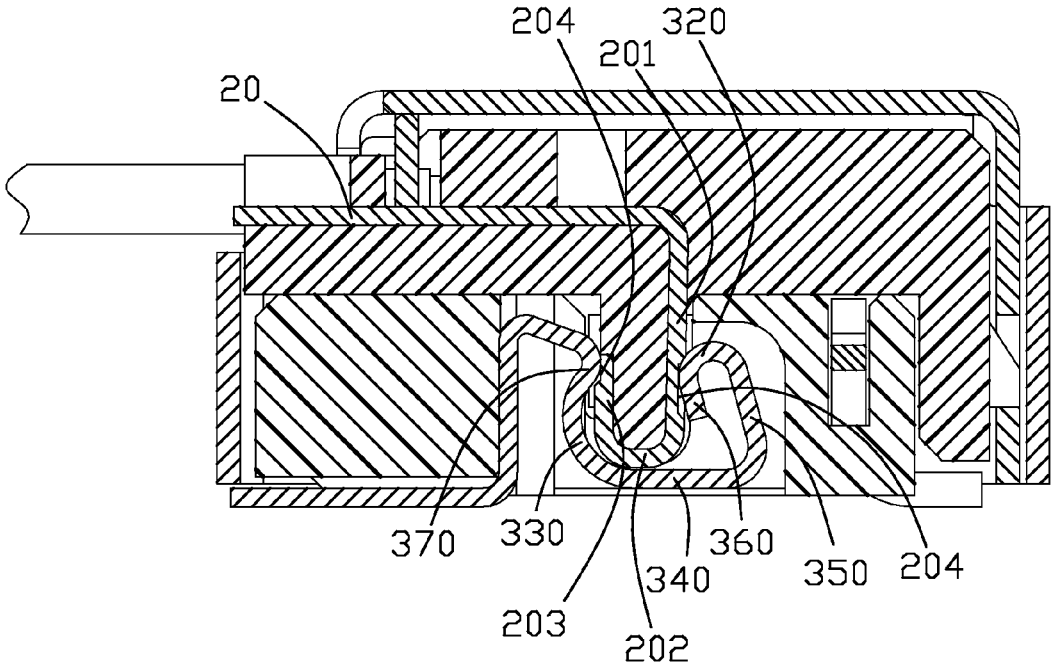
FIG. 9 is a cross-sectional view of the cable assembly connecting with the mating connector taken along line 9-9 of FIG. 1.

Referring to FIG. 9, the contacts set 20 includes a first and second signal contacts 21*a*, 21*b*, and first, second and third ground contacts 22*a*, 22*b*, and 22*c* alternatively arranged with respect to the signal contacts 21*a* and 21*b*, i.e. the signal contacts 21*a* and 21*b* are disposed between first and second ground contacts 22*a*, 22*b*, and second and third ground contacts 22*b*, 22*c*, respectively. Each of the contact set 20 has first arm 201 extending along the first direction, a second arm 203 extending a second direction opposite to the first direction, and an arcuate portion 202 connecting the first and second arm 201, 203. The first and second arms 201, 203 each defines a notch 204. The first arms 201 are disposed at one side of the mating portion 12, and the second arms 203 disposed at the opposite side of the mating portion 12.

Referring to FIG. 9, the shielding shell 30 comprises a top wall 31, a pair of side walls 32 vertically extending from an opposite sides of the top wall 31, and a protrusion 33 vertically extending from another side of the top wall 31 adjacent to the cables 120. Each of the side walls 32 defines a through hole 321 and an embossment 322 protruding into the shielding shell 30. The shielding shell 30 substantially encloses the base 11 and defining a receiving space 17.

The grounding plate 40 has a substantially rectangular shape. The grounding plat 40 comprises a first side edge 41 and a second side edge 42 opposite to the first side edge 41. The first side edge 41 includes a first and second arcuate indentations or circular notches 411*a*, 411*b*, and first, second and third flat portions 412*a*, 412*b*, and 412*c* alternatively arrange with the arcuate indentations 411*a*, 411*b*, i.e. the arcuate indentations 411*a* and 412*b* are disposed between the first and second flat portions 412*a*, 412*b*, and second and third flat portions 412*b*, 412*c*, respectively.

Referring to FIGS. 2, 3, 6, 7 and 8, each central conductor 121 of the cables 120 is electrically connected to the corresponding signal contacts 21*a*, 21*b*. Each of the cables 120 is partially received in the corresponding recess 13. Each of the recesses 13 is filled with glue for conglutinating the corresponding cable 120 to the insulative housing 10. The grounding plate 40 is received in the retaining slot 14. Each of the arcuate indentations 411*a*, 411*b* is mechanically and electrically connected to the corresponding braiding layer 123 of the cables 120. Each of the flat portions 412*a*, 412*b*, 412*c* mechanically and electrically connects to the corresponding ground contacts 22*a*, 22*b*, 22*c* respectively. The second side edge 42 is electrically connected to the shielding shell 30. Therefore, a reliable electrical connection between the braiding layers 123 of the cables and the shielding shell 30 is established. The mechanical connection between the cables 120 and the electrical connector 110 could be further reinforced by the ground plate 40. The through holes 321 of the shielding shell 30 engage with the corresponding tubers 16 of the insulative housing 10 to secure the shielding shell 30 on the insulative housing 10.

Referring to FIGS. 2, 3, 5 and 9, the mating housing 310 defines a mating recess 311. The mating portion 12 of the electrical connector 110 inserts into the mating recess 311. Therefore, the contact set 20 electrically connect with the mating contacts 320 respectively. Each of the mating contacts 320 has a first arcuate arm 330 extending from the top to the bottom of the mating housing 310, an arcuate portion 340 connecting to the top end of the first arcuate arm 330, an second arcuate arm 350 connecting to the arcuate portion 340 and extending to the bottom of the mating housing 310, and a third arcuate arm 360 connecting to the second arcuate arm 350 and extending obliquely to the first arcuate arm 330. Each of the first arcuate arms 330 is formed with a protrusion 370.

Each of the first arcuate arms 330 cooperates with each of the second and a third arcuate arms 350, 360 to clamp the corresponding a first arm 201 and a second arm, 203. Each of the protrusion 370 of the first arcuate arms 330 is received in the corresponding notch 204 of the second arms 203. Each of the third arcuate arms 360 is received in the corresponding notch 204 of the first arms 201. The mating housing 310 defines a pair of cutouts 312 on a pair of opposite outer surfaces thereof for mating with the corresponding embossments 322 of the shielding shell 30. The force used to separated the cable assembly 100 and mating connector 300 is increased. The connecting between the cable assembly 100 and the mating connector 300 is reliable.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly adapted for mating with a mating connector, comprising:

an electrical connector comprising an insulative housing, a plurality of contacts received in the insulative housing, and a shielding shell enclosing the insulative housing;

a cable electrically terminated to one end of the electrical connector, said cable having a metallic braiding layer; and a grounding plate attached to the housing and mechanically and electrically connecting with the braiding layer of the cable and the shielding shell; wherein said plurality of contacts comprises a signal contact electrical connected to the cable and two ground contacts located at opposite sides of the signal contact respectively; wherein said grounding plate comprises two flat portions mechanically and electrically connected to the two ground contacts respectively, and an arcuate indentation located between the two flat portions and mechanically and electrically connected to the metallic braiding layer of the cable; wherein the shielding shell comprises a protrusion disposed adjacent to the cable cooperating with the insulative housing to clamp the cable.

2. The cable assembly as recited in claim 1, wherein said insulative housing comprises a recess receiving the cable.

3. The cable assembly as recited in claim 2, wherein the recess is filled with glue for conglutinating the cable to the insulative housing.

4. The cable assembly as recited in claim 1, wherein said insulative housing is formed with a mating portion for inserting into the mating connector.

5. The cable assembly as recited in claim 1, wherein said insulative housing comprises a guiding portion for guiding the cable assembly to mate with the mating connector.

6. The cable assembly as recited in claim 1, wherein said insulative housing defines a retaining slot extending along a first direction perpendicular to an extending direction of the cable for receiving the grounding plate.

7. An interconnecting system, comprising:

a first connector, comprising an insulative housing and a plurality of first contacts received therein;

a second connector, mateable with the first connector and including a plurality of second contacts received therein, the second connector having a grounding bar;

a plurality of coaxial cables each terminated to one of the second contacts, and each including a metallic braiding interconnected by the grounding bar; and a metallic shell attached to the second connector and substantially enclosing the metallic braiding and the grounding bar, and interlocked to the first connector when the first and second connectors are mated; wherein said second contact defines a plurality of notches, and said first contact defines a plurality of on embossments engaged with the notches when the first and second connectors are mated; wherein each of the second contacts has a first arm extending along a direction perpendicular to an extending direction of the cable, and a second arm connecting with the first arm and extending in a second direction opposite to the first direction, and each of the first contacts has a first arcuate arm extending from a top to a bottom of the first connector insulative housing, a second arcuate arm connecting with the first actuate arm and extending from the bottom to the top of the housing, and a third actuate arm connecting with the second arcuate arm and extending inclined to the first arcuate arm; wherein said notches are located on the first and second arms, and said embossments are located on the first arcuate arms, said first arcuate arms cooperating with the second and third arcuate arms to clamp the first and second arms respectively.

8. The interconnecting system as recited in claim 7, wherein one of the first and second connectors comprises an embossment and the other connector comprises a cutout.

9. The interconnecting system as recited in claim 8, wherein said metallic shell comprises a top wall, and a pair of side walls vertically extending from an opposite sides of the top wall.

10. The interconnecting system as recited in claim 9, wherein said embossment is disposed on the side wall.

11. The interconnecting system as recited in claim 7, wherein said second connector comprises a second insulative housing formed with a pair of tubers, and said shielding shell defines a pair of through holes interlocked to the tubers, respectively.

12. An interconnecting system comprising:

an electrical connector for mating with a complementary connector;

said connector including:

an insulative housing defining opposite first and second faces;

a mating port defined on the first face for mating with the complementary connector;

a plurality of contacts disposed in the housing, each of said contacts defining a mating section exposed on the mating port, and a tail section exposed on the second face; and a plurality of wires soldered respectively upon some of said tail sections at a first position around a middle portion of the housing, while the remainder of said tail sections are exposed at a second position around a rear portion of the housing; further including a metallic shell enclosing said housing to shield said first position while leaving the second position outside of the shield; wherein said shell includes a rear wall bent to a final position to shield a rear face of the housing in a longitudinal direction along which said wires extend, and restrainedly confront the wires in a vertical direction perpendicular to said longitudinal direction, after the wires are soldered to the corresponding tail sections and the shell is downwardly assembled to the housing in said vertical direction.

* * * * *